US008636115B2

(12) United States Patent
Peacock et al.

(10) Patent No.: US 8,636,115 B2
(45) Date of Patent: Jan. 28, 2014

(54) HOSTING MACHINE SUPPORTING FRAME FOR JUMP LIFTS OF ELEVATORS

(75) Inventors: Mark Peacock, Riihimäki (FI); Zhizhong Yan, Espoo (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 13/444,423

(22) Filed: Apr. 11, 2012

(65) Prior Publication Data

US 2012/0217101 A1 Aug. 30, 2012

Related U.S. Application Data

(63) Continuation of application No. PCT/FI2010/000036, filed on May 27, 2010.

(30) Foreign Application Priority Data

Oct. 23, 2009 (FI) ..... 20090389

(51) Int. Cl.

| | |
|---|---|
| ***B66B 11/08*** | (2006.01) |
| ***B66B 19/00*** | (2006.01) |
| ***B66B 7/00*** | (2006.01) |
| ***B23P 11/00*** | (2006.01) |

(52) U.S. Cl.
USPC ..... 187/254; 187/414; 29/429

(58) Field of Classification Search
USPC ..... 187/254, 414, 900; 29/428–429, 525.01
IPC ..... B66B 11/04,11/08, 19/00, 19/02, 19/04
See application file for complete search history.

(56) References Cited

U.S. PATENT DOCUMENTS

| | | | | |
|---|---|---|---|---|
| 5,773,771 | A * | 6/1998 | Chatham | 187/282 |
| 5,971,109 | A * | 10/1999 | Aulanko et al. | 187/263 |
| 2007/0034455 | A1 * | 2/2007 | Coquerelle et al. | 187/414 |

FOREIGN PATENT DOCUMENTS

| | | | | |
|---|---|---|---|---|
| FI | 117335 | B1 | 9/2006 | |
| FR | 2694279 | A1 | 2/1994 | |
| JP | 8133636 | A | 5/1996 | |
| WO | WO 0007923 | A1 * | 2/2000 | B66B 19/00 |

OTHER PUBLICATIONS

EPO Machine Translation, FR2694279A1, pp. 2.*
International Search Report.

* cited by examiner

*Primary Examiner* — William A Rivera
*Assistant Examiner* — Stefan Kruer
(74) *Attorney, Agent, or Firm* — Harness, Dickey & Pierce, P.L.C.

(57) ABSTRACT

An elevator arrangement includes an elevator hoistway, an elevator car, and a movable supporting platform for supporting the elevator components in the elevator hoistway. The supporting platform includes a supporting frame. The supporting frame includes a plurality of beams that are rigidly fixed to each other. The plurality of beams are arranged such that towards each of all four lateral directions of the supporting platform points at least one beam end of the supporting frame, at which beam end is a movable support element belonging to a plurality of movable support elements movable between a position extended from the platform towards the side and a position retracted towards the platform.

27 Claims, 3 Drawing Sheets

HOSTING MACHINE SUPPORTING FRAME FOR JUMP LIFTS OF ELEVATORS

CROSS-REFERENCE TO RELATED APPLICATIONS

Figure 1:
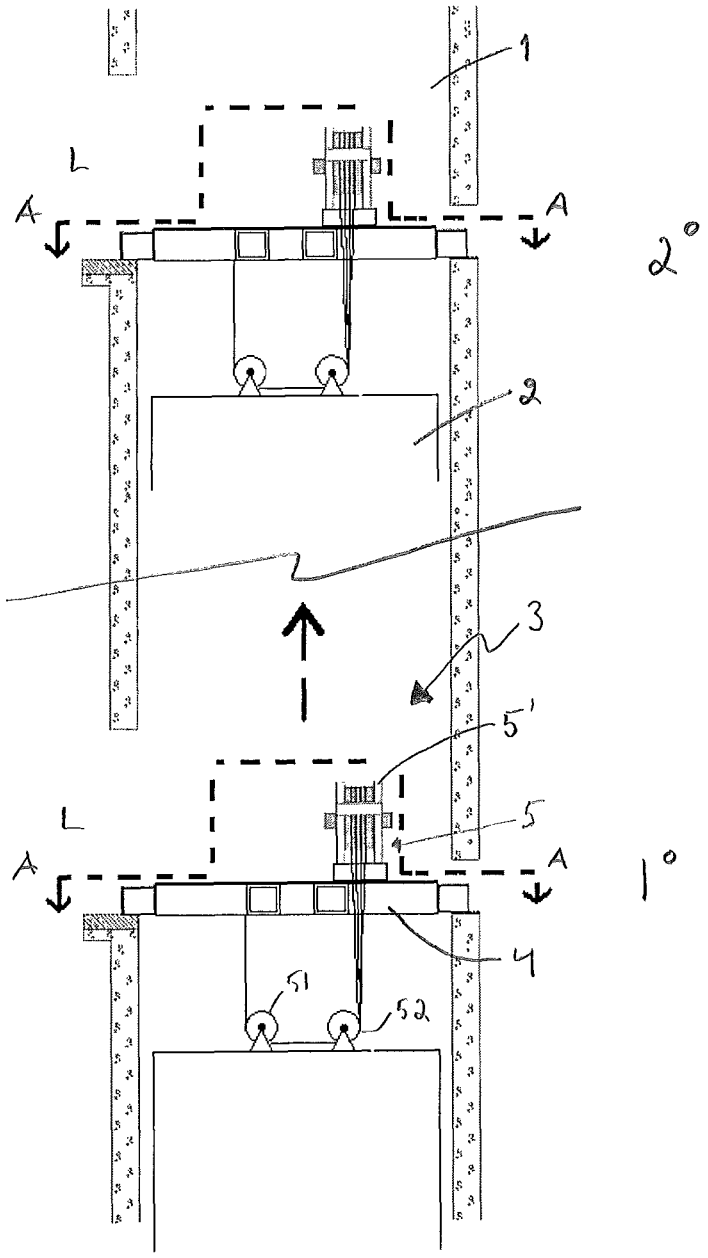

This application is a continuation of International Application Number PCT/FI2010/000036 filed on May 27, 2010 and claims priority to Finnish Application Number FI20090389 filed on Oct. 23, 2009, the entire contents of each of which are hereby incorporated herein by reference.

FIELD OF THE INVENTION

The object of the invention is an elevator arrangement and a method in the installing of an elevator, which elevator is preferably an elevator to be installed in a building and applicable to passenger transport and/or freight transport, and in which elevator arrangement and method the elevator is/can be taken into service use already during its construction.

BACKGROUND OF THE INVENTION

In connection with so-called jump-lifts, the elevator hoistway is taken into use already before the full length of the elevator hoistway has been completed. The top part of the elevator hoistway is constructed at the same time as an elevator car moving in the already completed bottom part of the elevator hoistway serves people on the lower floors of the building. In jump-lifts, the elevator car moving in the lower part of the elevator hoistway is supported and moved during the construction-time use suspended on hoisting ropes that are supported by a supporting platform in the elevator hoistway, which ropes are moved with a hoisting machine that is usually supported on the supporting platform. The installation work in the upper parts of the elevator hoistway above this supporting platform is done from a movable platform or corresponding. When the part of the elevator hoistway under construction above the supporting platform has reached a sufficient stage of completion, the completed part of the elevator hoistway can be taken into use. In this case a jump-lift is performed, wherein the supporting platform is raised to a higher position in the elevator hoistway, thus extending the operating area of the elevator car upwards. A worksite crane in use in the construction of the building or a lighter hoisting appliance to be supported on the building and arranged for the site for the purpose of the elevator installation can, for example, be used for the lifting. When the elevator hoistway has reached its final height, the supporting platform has conventionally been removed from the elevator hoistway and a machine room has been built at the end of the elevator hoistway, after which the final hoisting machine of the elevator has been brought to the machine room. In prior art the support structure of the supporting platform is formed by keeping the number of support elements small and by arranging the supporting platform to be supported by only two walls of the elevator hoistway that are opposite each other. A problem has been that it has not been possible to utilize the same support structure solution sufficiently freely in elevator solutions that are different types in terms of their layout. The supporting process of the supporting platform has also caused problems. Supporting has earlier been slow to perform, the structures used for supporting have been complex, and the structure achieved has been awkward to make stable without excessively impacting the compactness of the elevator or the other elevator components. Arranging advantageous support for the supporting platform, particularly in the final phase of the process, has been a problem. It has also been a problem that, in order to stabilize the supporting, the placement of components supported by the supporting platform has been awkward to arrange while keeping the structure stable. Additionally, improving the safety of personnel is a continuous objective. In addition, further utilization of the structures has not been sufficient.

AIM OF THE INVENTION

The object of the invention is to eliminate, among others, the aforementioned drawbacks of prior-art solutions. More particularly the aim of the invention is to produce an elevator arrangement and method in the installation of an elevator that have better support.

SUMMARY OF THE INVENTION

The invention is based on the concept that by forming the supporting frame of the supporting platform to comprise a plurality of beams that are rigidly fixed to each other, which beams are arranged such that towards each of all four lateral directions of the supporting platform points at least one beam end of the supporting frame, at which beam end is a movable support element belonging to the aforementioned plurality of support elements, the supporting can be arranged to be supportive, robust, simple and safe. In this case also the forces exerted on the building by the supporting platform can be distributed to points that are at a sufficient distance from each other.

In one basic embodiment of the concept according to the invention, the elevator arrangement comprises an elevator hoistway, an elevator car, a movable supporting platform for supporting the elevator components in the elevator hoistway, which supporting platform comprises a supporting frame, which comprises a plurality of support elements movable between a position extended from the supporting platform towards the side and a position retracted towards the supporting platform, supported on which support elements in their extended position the supporting frame can be lowered to rest on top of the wall structures of the elevator hoistway, for the vertical supporting of the supporting platform in the elevator hoistway, and in the retracted position of which support elements the supporting platform can be moved in the vertical direction in the elevator hoistway without being obstructed by the support elements. The supporting frame comprises a plurality of beams that are rigidly fixed to each other, which beams are arranged such that towards each of all four lateral directions of the supporting platform points at least one beam end of the supporting frame, at which beam end is a movable support element belonging to the aforementioned plurality of support elements. In this way the aforementioned advantages are achieved.

In a more refined embodiment of the concept of the invention, each aforementioned support element can be moved in the longitudinal direction of the beam, telescopically in relation to the beam, between an extended and a retracted position. Thus the construction is simple and robust.

In a more refined embodiment of the concept of the invention, the supporting platform is the supporting platform of the elevator car below the supporting platform.

In a more refined embodiment of the concept of the invention, the aforementioned plurality of beams is arranged such that towards each of four lateral directions of the supporting platform point two beam ends of the supporting frame, at each of which beam ends is a support element that belongs to the aforementioned plurality of support elements and is moveable in the longitudinal direction of the beam in question. Thus the construction is stable and the point loads can be reduced.

In a more refined embodiment of the concept of the invention, the aforementioned plurality of beams is arranged such that towards each of the four lateral directions of the supporting platform point two beam ends of the supporting frame, at each of which beam ends is a support element that belongs to the aforementioned plurality of support elements and is moveable in the longitudinal direction of the beam in question, and that the beam ends that point towards a first and a second lateral direction that are opposite to each other are at a first horizontal distance from each other, and that the beam ends that point towards a third and a fourth lateral direction that are opposite to each other are at a second horizontal distance from each other, which second horizontal distance is greater than the first. In this way the structure can be fitted compactly with the other parts of the elevator.

In a more refined embodiment of the concept of the invention, the aforementioned plurality of beams is arranged such that towards each of two lateral directions of the supporting platform that are opposite to each other point two parallel beam ends of the supporting frame, at each of which beam ends is a support element that belongs to the aforementioned plurality of support elements and is moveable in the longitudinal direction of the beam in question, and which two parallel beam ends are at a horizontal distance from each other such that a space is left between them, via which space the car guide rail line passes. One advantage is that the solution produces the ability to efficiently utilize hoistway space in the transverse direction.

In a more refined embodiment of the concept of the invention, the aforementioned plurality of beams is arranged such that towards each of a first and a second lateral direction of the supporting platform that are opposite to each other point two parallel beam ends of the supporting frame, at each of which beam ends is a support element that belongs to the aforementioned plurality of support elements and is moveable in the longitudinal direction of the beam in question, which support element in the extended position reaches inside a pocket in the concrete wall of the elevator hoistway, and the support element of the beam end pointing towards the first or towards the second direction rests on the top surface of the aperture of the floor landing. One advantage is a supportive, safe and space-efficient solution, wherein some of the support elements can be activated simply from a floor landing.

In a more refined embodiment of the concept of the invention, the supporting frame supports the elevator hoisting machine fixed to the supporting frame, which hoisting machine is disposed such that the center point of its weight is at a distance from the center point of the supporting frame.

In a more refined embodiment of the concept of the invention, the supporting frame comprises first means for moving the support elements between an extended and a retracted position, with which first means the support elements of the beams pointing towards the lateral directions (D1,D2) that are opposite to each other are arranged to be moved, and which means comprise power input means disposed on the floor landing side of the supporting frame, via which power input means power is arranged to be supplied, while working from the floor landing on the side of the supporting frame, for moving both the support elements of the aforementioned beams that point towards opposite lateral directions. Thus, while working from a floor landing, the support elements of the beams pointing towards opposite directions can be activated or de-activated.

In a more refined embodiment of the concept of the invention, the first means comprise power input means $I_2$ in connection with the same support element, via which power input means power is arranged to be supplied for moving the support elements of the aforementioned beams that point towards opposite lateral directions. Thus it is possible to operate safely from a floor landing.

In a more refined embodiment of the concept of the invention, the power input means $I_1$ comprise a pulling/pushing means, such as a handle, that is fixed on the support element of the beam end that points towards the first lateral direction, and a pulling/pushing means in the longitudinal direction of the beam, such as a rod, that is fixed on, or can be fixed to, the support element of the beam end that points towards the second lateral direction. Thus manual operation from the same floor landing is enabled.

In a more refined embodiment of the concept of the invention, the supporting frame comprises second means for moving the support elements, which means comprise power, more particularly torque, input means $I_2$ and a mechanical power transmission, which is arranged to convert the rotational movement produced by the torque supplied to the power input means $I_2$, more particularly to the shaft comprised in said means, into simultaneous movement of both the support elements at the beam ends pointing towards opposite lateral directions towards an extended position or towards a retracted position, depending on the torque direction. Thus the position of the power input supply can be freely selected and selected to be safe.

In a more refined embodiment of the concept of the invention, the supporting frame comprises first means for moving the support elements and second means for moving the support elements, with which first means the support elements of the beams pointing towards the lateral directions (D1,D2) that are opposite to each other are arranged to be moved, and with which second means the support elements of the beams pointing towards the lateral directions (D3, D4) that are opposite to each other are arranged to be moved, and that the operating power input means $I_1$ of the first means are power input means $I_1$ disposed on the floor landing side of the supporting frame for enabling the supply of power while working on the floor landing, and the operating power input means $I_2$ of the second means are at a horizontal distance from the aforementioned beam ends and from the aforementioned support elements for enabling use of the second means from the supporting platform. Thus it can be ensured in stages that there is no need to go onto the platform before it is safe.

In a more refined embodiment of the concept of the invention, the supporting frame comprises first means and second means for moving the support elements, with which first means the support elements of the beams pointing towards the first and the second lateral direction that are opposite to each other are arranged to be moved, and with which second means the support elements pointing towards the third and the fourth lateral direction that are opposite to each other are arranged to be moved. Thus a graduation of the movement of the support elements is enabled, and some of the means can be formed to be simpler than the other means.

In a more refined embodiment of the concept of the invention, the power input means $I_2$ comprise an input shaft, which is preferably vertical, and that the power transmission is arranged to convert the rotational movement of the aforementioned shaft into pull/push to be exerted on the support elements, for moving the support element between a retracted and an extended position. Thus it is simple and space-efficient to perform the power input.

In a more refined embodiment of the concept of the invention, a motorized power means, preferably a portable electrically-driven rotation device, is connected, or can be connected, to the input means $I_2$. Thus the power supply can be simply implemented and with a rotator applicable even to some other use also.

In a more refined embodiment of the concept of the invention, the power transmission comprises a gear connected to a power input shaft, most preferably an angle transmission of the bevel-gear-pair type or a worm gear, which gear is arranged to convert the rotational movement of the shaft into pull/push to be exerted on the support elements. Thus the construction is simple and effective.

In a more refined embodiment of the concept of the invention, the supporting platform comprises openable joint means, with which at least some of the beam ends that point towards different directions are fixed rigidly into position to the rest of the supporting frame, preferably end-to-end in a beam that is parallel with the beam end in question. Thus the fixed length of the beam can be fitted to be that desired. The beam end can thus, with regard to its fixed section, be fitted to extend to the desired distance in the lateral direction from the rest of the supporting frame, e.g. by adding or removing extension pieces of the beams or by selecting a beam end that is of a suitable length for the location. Thus the supporting platform can be converted to be the most suitable for the dimensions of each elevator hoistway.

In one basic embodiment of the concept of the invention, in the method in the installing of an elevator, in which method the supporting platform above the elevator car is raised upwards in the elevator hoistway, and the range of movement of the elevator car is changed to extend farther upwards in the elevator hoistway, which elevator is arranged to comprise an elevator hoistway, an elevator car, a movable supporting platform for supporting the elevator components in the elevator hoistway, which supporting platform comprises a supporting frame, which comprises a plurality of support elements movable between a position extended from the platform towards the side and a position retracted towards the platform, in which method the supporting platform is moved in the vertical direction in the elevator hoistway when the support elements are in the retracted position, after which the support elements are moved into the extended position and the frame of the supporting platform is lowered to rest on the wall structures of the elevator hoistway supported by the support elements in the extended position for the vertical supporting of the supporting platform in the elevator hoistway. The supporting frame comprises a plurality of beams that are rigidly fixed to each other, which beams are arranged such that towards each of all four lateral directions of the supporting platform points at least one beam end of the supporting frame, at which beam end is a movable support element belonging to the aforementioned plurality of support elements. The advantages of each method become evident in connection with the advantages of the embodiments of the arrangement or from elsewhere in this patent application.

In a more refined embodiment of the concept of the invention, in the method the support elements of the beams pointing towards the first and the second lateral directions that are opposite to each other are moved into the extended position, after which the support elements of the beams pointing towards the third and the fourth lateral directions that are opposite to each other are moved into the extended position, after which the supporting frame is lowered to rest on the wall structures of the elevator hoistway supported by the support elements.

In a more refined embodiment of the concept of the invention, in the method the support elements of the beams pointing towards the first and the second lateral directions that are opposite to each other are moved into the extended position from the floor landing of the building, and the support elements of the beams pointing towards the third and the fourth lateral directions that are opposite to each other are moved into the extended position from the supporting platform.

In a more refined embodiment of the concept of the invention, in the method the support elements of the beams that point towards opposite lateral directions are moved into the extended position while working from the floor landing that is on the side of the supporting frame by supplying power into the power input means $I_1$ that are disposed on the floor landing side of the supporting frame and that are comprised in the first moving means of the supporting frame.

In a more refined embodiment of the concept of the invention, in the method the support elements of the beams pointing towards the third and the fourth lateral directions that are opposite to each other are moved into the extended position by supplying power into the operating power input means $I_2$ that are comprised in the second moving means of the support elements and that are disposed in the center area of the supporting platform.

In a more refined embodiment of the concept of the invention, in the method the beam structure of the supporting frame is used for forming the structure supporting the machinery of the final machine room of the elevator, which supporting frame has earlier been in its position in a position disposed lower in the elevator hoistway, and which supporting frame was used in the aforementioned lower disposed position for supporting the machinery. Some advantages, among others, are the speeding up of the process because the additional need for supporting support structures in the installation of the machine room decreases, the need to disassemble a temporary machine room platform decreases, and the solution brings material savings.

In a more refined embodiment of the concept of the invention, the supporting frame is lifted so that its beam ends move through from an aperture leading into the space reserved for the final machine room, which space is an extension of the elevator hoistway, such that the support elements are in the retracted position, after which the support elements are moved into the extended position, and the supporting frame is lowered to be supported by the edges of the aforementioned aperture, which edges are load-bearing structures of the building.

In a more refined embodiment of the concept of the invention, the first means can transmit the push and/or pull brought into the power input means to the support element(s).

In a more refined embodiment of the concept of the invention, in the installation phase of the supporting platform the fixed section of the beam ends is fitted to extend to a suitable distance from the rest of the supporting structure by selecting a beam end of a suitable length and by rigidly fixing the beam end into its position to the rest of the supporting frame, preferably end-to-end in a beam parallel with the beam end in question, with openable joint means.

Some inventive embodiments are also presented in the descriptive section and in the drawings of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. The features of the various embodiments can be applied within the framework of the basic inventive concept in conjunction with other embodiments. Each embodiment can also singly and separately from the other embodiments form a separate invention.

LIST OF FIGURES

In the following, the invention will be described in detail by the aid of some examples of its embodiments with reference to the attached drawings, wherein FIG. 1 presents a diagrammatic side view of a preferred construction-time jump-lift arrangement of an elevator in a building at the point B-B of FIG. 2, with which jump-lift arrangement the method according to the invention can be performed.

Figure 2:
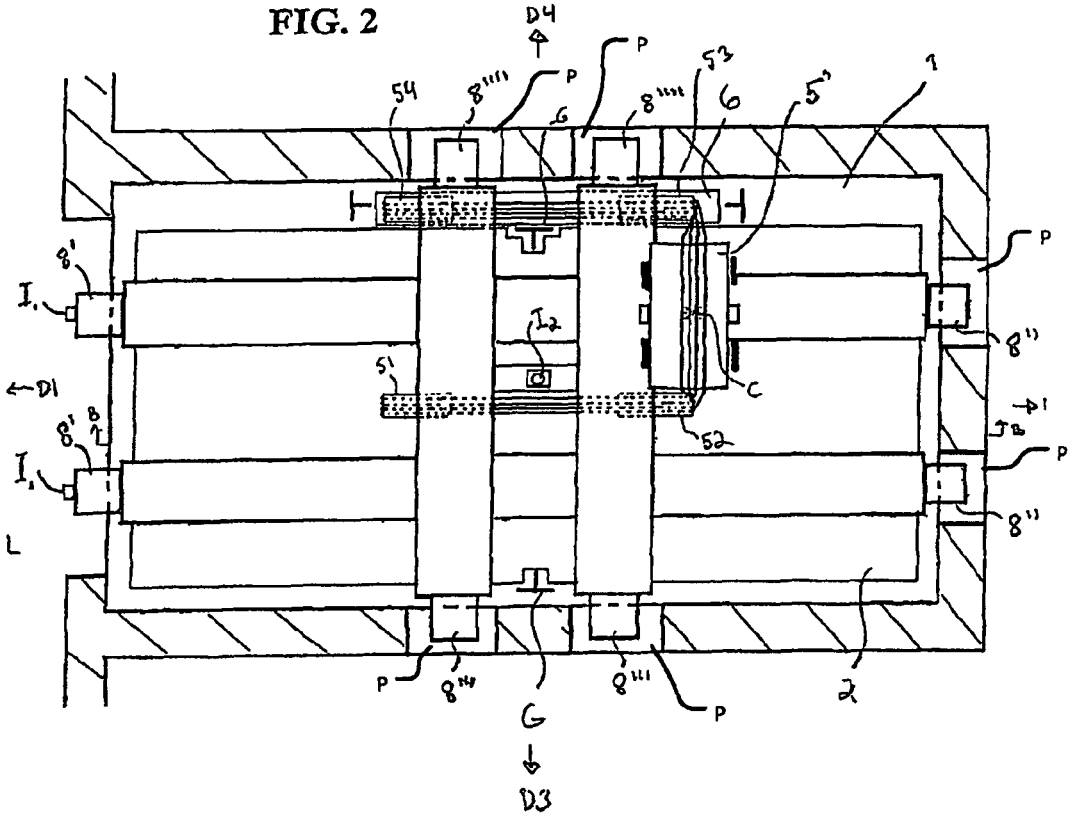

FIG. 2 presents an A-A section of FIG. 1 as viewed from above.

Figure 3:
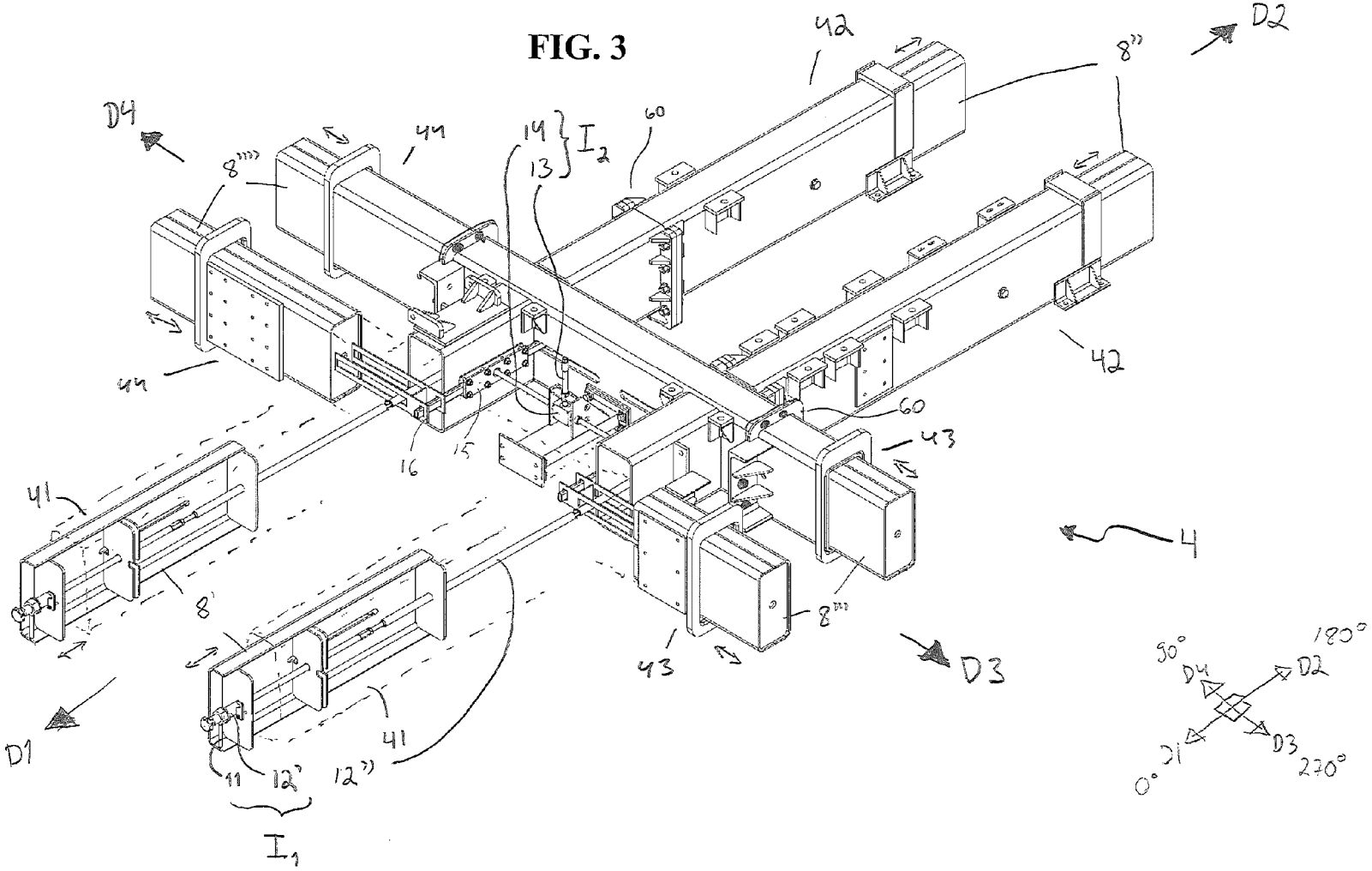

FIG. 3 presents the supporting platform of FIGS. 1 and 2 in more detail.

DETAILED DESCRIPTION OF THE INVENTION

The elevator arrangement according to FIGS. 1 and 2 comprises an elevator hoistway 1 and an elevator car 2, which can move in the elevator hoistway 1 when the elevator is in use. The arrangement further comprises a movable supporting platform 3 for supporting the elevator components in the elevator hoistway. The guide rails (not shown) of the elevator car in the part of the elevator hoistway 1 below the supporting platform 3 are already fixed to the walls of the elevator hoistway. Above the structure, where the elevator hoistway is unfinished, the work to install the car guide rails can be performed, e.g. from a separate working platform. The supporting platform 3 can be moved with a hoist (not presented) from the position 1° presented in FIG. 1 higher in the elevator hoistway to the position 2°. The supporting platform 3 comprises a supporting frame 4, which comprises a plurality of support elements 8'-8'''' that are movable between a position extended from the platform towards the side and a position retracted towards the platform and that enable the moving and re-supporting of the supporting platform, supported on which support elements in their extended position the frame of the supporting platform can be lowered to rest on top of the wall structures of the elevator hoistway, for the vertical supporting of the supporting platform in the elevator hoistway, and in the retracted position of which support elements the supporting platform 3 can be moved in the vertical direction in the elevator hoistway without being obstructed by the support elements. The supporting frame 4 comprises a plurality of beams that are rigidly fixed to each other, which beams are arranged such that towards each of all four lateral directions (D1,D2, D3,D4) of the supporting platform point two beam ends (41-44) of the supporting frame, at which beam ends is a movable support element (8'-8'''') belonging to the aforementioned plurality of support elements. Thus the supporting platform is strong and can be firmly and safely supported in position in the hoistway with little loading of the support points.

Each aforementioned support element 8'-8'''' can be supported on the wall structures of the elevator hoistway 1. The aforementioned wall structures can comprise fixed structures that form the wall of the elevator hoistway, such as e.g. the beams or concrete structures of the building. Preferably, as presented in the figures, the wall structure of the elevator hoistway comprises pockets P in the concrete wall of the elevator hoistway, on which pockets some of the support elements can be supported. The wall structure of the elevator hoistway also comprises apertures opening to the platform, on the surface of which aperture some of the support elements can be supported, e.g. via a support plate.

The supporting platform 3 is preferably the supporting platform 3 of the elevator car 2 that is below the supporting platform and the supporting frame 4 supports the elevator hoisting machine 5 fixed to the supporting frame 4, which hoisting machine is arranged to move the elevator car between jump-lifts via the hoisting roping when the elevator is in use. In the solution presented, the hoisting roping descends from the fixing that is in connection with the supporting frame to the diverting pulley 51 of the elevator car, from where it passes to the diverting pulley 52 and rises upwards and passes around the traction sheave 5' and at the same time over one beam of the supporting platform, from which traction sheave it descends to the diverting pulley 53 of the counterweight 6 and moves to the second diverting pulley 54 of the counterweight 6 and rises upwards to the fixing that is in connection with the supporting frame 4. The other end of the rope passes via a fixing to the rope supply storage (not presented) for taking the additional rope required by a jump-lift. As presented in FIG. 2, towards each of two lateral directions (D3 and D4) of the supporting platform that are opposite to each other point two parallel beam ends (43,44) of the supporting frame, at each of which beam ends is a support element (8) that belongs to the aforementioned plurality of support elements and is moveable in the longitudinal direction of the beam in question, and which two parallel beam ends are at a horizontal distance from each other such that a space is left between them, via which space the car guide rail line passes. Thus the solution efficiently utilizes hoistway space in the lateral direction. The structure can thus also be simply made to be essentially symmetrical and stable. These parallel beam ends (43, 44) that point towards a first and a second lateral direction (D1,D2) that are opposite to each other are at a first horizontal distance from each other. This first horizontal distance can be kept small, because swaying is prevented with the beams pointing towards the directions D3 and D4. The beam ends that point towards the third and the fourth lateral direction (D3, D4) that are opposite to each other are at a second horizontal distance from each other, which second horizontal distance is greater than the first. Thus a balanced structure is achieved, which is at the same time compact. Thus the hoisting rope can be arranged to pass by the parallel beam ends (pair 43 or pair 44) on the outside of them and correspondingly the hoisting rope can be arranged to pass down/up between the parallel beams (pair 41 or pair 42) without space problems. The arrangement presented is reliably stable and the supporting frame 4 can without problem be arranged in the manner presented to support the elevator hoisting machine (5) fixed to the supporting frame (4), which hoisting machine is disposed such that the center point C of its weight is at a horizontal distance from the center point of the supporting frame as viewed from above, more particularly at a distance from the lines of symmetry of the beam pairs that point towards the four lateral directions. At the same time the point C of it in the embodiment presented is outside the polygon delimited by the center lines of the beam ends 41-44.

FIG. 3 presents the structure of the supporting frame 4 in more detail. Each aforementioned support element 8'-8'''' can be moved horizontally in the longitudinal direction of the beam, telescopically in relation to the beam, between an extended and a retracted position. More particularly, the support elements can be moved telescopically inside the beam. The beams and the support elements are preferably hollow metal profile parts. The beam ends 41-44 are fixed to each other, e.g. by welding and/or with a bolt fixing, such that they are one rigid structure. Some of the beams 41, 44 have been removed out of sight from the figure in order to illustrate the structure.

For moving the support elements between positions, the supporting frame 4 comprises first means (11,12',12") for moving the support elements (8',8") between an extended and a retracted position, with which first means the support elements (8',8") of the beams pointing towards the lateral directions (D1,D2) that are opposite to each other are arranged to be moved, and which means comprise power input means $I_1$ disposed on a first and/or on a second side of the supporting frame, via which power input means power is arranged to be supplied, while working from the floor landing on the side of the supporting frame, for moving both the support elements (8',8") of the aforementioned beams that point towards opposite lateral directions (D1,D2). These means (11,12) comprise power input means $I_1$ in connection with the same support element 8', via which power input means (preferably manual) power is arranged to be supplied for moving the support elements (8',8") of the aforementioned beams that point towards opposite lateral directions (D1,D2). The power input means $I_1$ comprise at least a pull/push handle (11), that is fixed on the support element (8') of the beam end that points towards the first lateral direction (D1), and a pull/push rod 12' in the longitudinal direction of the beam 42 that is fixed on, or can be fixed to, the support element 8' of the beam end that points towards the second lateral direction D2. By means of the pulling handle the support element 8' can be safely pulled from the floor landing into the extended position. Likewise the opposite support element 8" can be safely pushed from the same floor landing into the extended position with the rod 12'. In this case, the second rod 12" is preferably pushed with the rod 12', but they can also be an integral structure. Correspondingly, from the floor landing the support elements can be safely moved back into the retracted position.

The supporting frame 4 also comprises second means 15 and 16 for moving the support elements, which means comprise power, more particularly torque, input means $I_2$ and a mechanical power transmission, which is arranged to convert the rotational movement produced by the torque supplied to the power input means $I_2$, more particularly to the shaft comprised in said means, into simultaneous movement of both the support elements (8''',8'''') at the beam ends pointing towards opposite lateral directions towards an extended position or towards a retracted position, depending on the torque direction. The second means can be disposed such that the use of them can be performed from the platform. For example, the support elements (8''',8'''') can be moved into the extended position with them when the other support elements have earlier already been safely activated from the floor landing. The power input means $I_2$ comprise an input shaft 13, which is preferably vertical, and the power transmission is arranged to convert the rotational movement of the aforementioned shaft into pull/push to be exerted on the support elements (8''',8''''), for moving the support element (8''',8'''') between a retracted and an extended position. A motorized power means, preferably a portable electrically-driven rotation device, is connected, or can be connected, to the input means $I_2$. In this way the procedure to be performed from the platform is quick to perform. As presented in FIG. 3, the power transmission comprises a gear 14 connected to the power input shaft. The gear is preferably an angle transmission of the bevel-gear-pair type as presented in the figure, but it could also be a worm gear. The gear is arranged to convert the rotational movement of the shaft into pull/push to be exerted on the support elements (8''',8''''). The input means $I_2$ are disposed in the central area of the supporting platform in the lateral direction for enabling safe working on the platform. When moving the support elements between positions the supporting platform is supported with a lifting device so that the support elements are not loaded in this phase.

In the method according to the invention the elevator hoistway above the supporting platform is constructed when the elevator car of the supporting platform is already in use. When the construction of the elevator hoistway has progressed to a sufficient stage of completion, a jump-lift can be performed utilizing the arrangement presented above for changing the range of movement of the elevator car 2 in steps so that it reaches to higher in the elevator hoistway 1. This is arranged to be performed by lifting the supporting platform that is above the elevator car upwards in the elevator hoistway 1.

After each jump-lift the platform 3 supporting the machinery 5 is supported in its position in the elevator hoistway 1 supported by the supporting frame 4, the support elements 8'-8'''' of which supporting frame have been made to extend to rest on the top surface of a load-bearing structure of the wall structures of the elevator hoistway 1. After this the elevator car 2 is moved back into use to serve passengers and/or to transport goods. Preferably a number of jump-lifts of this type are performed, until the supporting platform 3 is close to the final height of the elevator. In this case the elevator is converted into the final elevator, leaving in place at least the construction-time guide rails, most of the hoistway structure, and most of the construction-time car and possibly also of the counterweight. In the method the arrangement for performing the jump-lift is that presented. The supporting frame 4 thus comprises a plurality of beams that are rigidly fixed to each other, which beams are arranged such that towards each of all four lateral directions (D1,D2,D3,D4) of the supporting platform point two beam ends (41-44) of the supporting frame, at which beam ends is a movable support element (8'-8'''') belonging to the aforementioned plurality of support elements. Of course, advantages can be achieved with the arrangement also if towards each direction D1-D4 points one beam end, or towards some of the directions point two beam ends and towards some of the directions points one beam end. As presented in FIG. 3, but not necessarily, the supporting platform can comprise detachable joint means 60, with which at least some of the beam ends that point towards different directions are fixed rigidly into position to the rest of the supporting frame, preferably end-to-end in a beam that is parallel with the beam end in question. Thus the fixed length of the beam can be fitted to be that desired for different locations by adding or removing extension pieces of the beams or by selecting a beam end that is of a suitable length for the location.

According to the method, in a jump-lift after lifting the supporting platform to the next higher position 2° the support elements (8' and 8") of the beams pointing towards the first D1 and the second D2 lateral directions that are opposite to each other are moved into the extended position, after which the support elements (8''',8'''') of the beams pointing towards the third (D3) and the fourth (D4) lateral directions that are opposite to each other are moved into the extended position, after which the supporting frame (4) is lowered to rest on the wall structures of the elevator hoistway supported by the support elements (8'-8''''). Thus the structure can be safely lowered into position. More precisely, this phase is performed such that the support elements (8' and 8") of the beams pointing towards the first (D1) and the second (D2) lateral directions that are opposite to each other are moved into the extended position from the floor landing of the building, and the support elements (8''',8'''') of the beams pointing towards the third (D3) and the fourth (D4) lateral directions that are opposite to each other are moved into the extended position from the supporting platform (4). In this way safety can be guaranteed because before moving onto the platform at least a part of the support elements have already been moved into the extended position. Further, more precisely speaking, in the method the support elements (8',8'') of the beams that point towards opposite lateral directions (D1,D2) are moved into the extended position while working from the floor landing that is on the side of the supporting frame by supplying power into the power input means ($I_1$) that are disposed on the floor landing side of the supporting frame and that are comprised in the first moving means (11,12',12'') of the supporting frame. The supplying can be performed manually such that the rod 12'', which is connected to the support element 8'', is pushed with the rod 12'. The support element 8' is moved by supplying tractive power preferably manually into the handle 11. Thus a simple structure and safe working are made possible. In the method the support elements (8''' and 8'''') of the beams pointing towards the third (D3) and the fourth (D4) lateral directions that are opposite to each other are moved into the extended position by supplying power into the operating power input means (10 that are comprised in the second moving means of the support elements and that are disposed on the supporting platform, preferably in the central area of it. The power supplied is preferably rotation. Thus the supply of power is safe and simple to perform.

The structure of the supporting frame presented enables its easy convertibility also for further use in the final elevator. In the method, the beam structure of the supporting frame 4 is preferably used for forming the structure supporting the machinery of the final machine room of the elevator. In this case after jump-lifts the supporting frame 4 is further lifted so that its beam ends move through from an aperture leading into the space reserved for the final machine room, which space is an extension of the elevator hoistway 1, such that the support elements (8'-8'''') are in the retracted position, after which the support elements are moved into the extended position, and the supporting frame is lowered to be supported by the edges of the aforementioned aperture, which edges are load-bearing structures of the building.

Generally speaking, the beams mentioned in the invention, the ends of which point towards the four lateral directions (D1-D4) of the platform are, as presented, most preferably on essentially the same plane and in a horizontal position. The beams (41 and 42; 43 and 44) that point towards opposite directions are most preferably on the same line as each other. The machinery 5 preferably forms an entity, which comprises an electric motor and a traction sheave 5'', and further also a drive of an electric motor. The invention relates especially preferably to solutions in which the elevator hoistway 1 is formed inside the building.

By means of the method/arrangement, the elevator to be constructed will come to form the final permanent elevator of the building after the building is completed. During the construction-time use of the elevator car the supporting platform in the arrangement presented is supported in the vertical direction only by the support elements of the supporting frame. As presented in FIG. 3, the four lateral directions point such that from the direction D1 clockwise, the direction D2 is at 180 degrees, direction D3 is at 270 degrees and direction D4 at 90 degrees.

It is obvious to the person skilled in the art that the invention is not limited to the embodiments described above, in which the invention is described using examples, but that many adaptations and different embodiments of the invention are possible within the frameworks of the inventive concept defined by the claims presented below. For example, the support elements could be different to what is presented, e.g. folding. Likewise the invention is suited to elevators with other types of reeving or machinery layout. Likewise the invention is suited, e.g. as a structure of the supporting platform to be arranged for lifting the machine room platform.

The invention claimed is:

1. An elevator system, comprising:
an elevator car; and
a movable supporting platform to support elevator components in an elevator hoistway, the movable supporting platform including,
a supporting frame having a plurality of support elements movable between an extended position and a retracted position,
wherein, in the extended position, the plurality of support elements are configured to vertically support the movable supporting platform in the elevator hoistway when lowered to rest on wall structures of the elevator hoistway, and
wherein, in the retracted position, the plurality of support elements are configured to allow movement of the movable supporting platform in the vertical direction in the elevator hoistway,
wherein the supporting frame includes,
a plurality of beams that are rigidly fixed to each other, the plurality of beams being arranged such that two beam ends of the supporting frame point towards each of four lateral directions of the movable supporting platform, and
wherein a support element from among the plurality of support elements is positioned at each of the at least one beam end.

2. The elevator system according to claim 1, wherein the supporting frame is configured to support an elevator hoisting machine.

3. The elevator system according to claim 2, wherein the elevator hoisting machine is arranged such that a center point of the weight of the elevator hoisting machine is offset from a center point of the supporting frame.

4. The elevator system according to claim 1, wherein the supporting frame comprises:
a push/pull rod configured to move the plurality of support elements between the extended and retracted positions.

5. The elevator system according to claim 4, further comprising:
a handle fixed to a support element at a beam end pointing in a first of the four lateral directions; wherein
the push/pull rod is arranged in the longitudinal direction of the beam pointing in a second of the four lateral directions.

6. The elevator system according to claim 1, wherein the supporting frame comprises:
an input shaft configured to move the plurality of support elements between the extended and retracted positions; and
a gear configured to convert rotational movement produced by torque supplied to the input shaft to move support elements at beam ends pointing towards opposite lateral directions between the extended position and the retracted position.

7. The elevator system according to claim 6, wherein the input shaft is arranged vertically.

8. The elevator system according to claim 6, wherein the gear is a bevel-gear-pair type or a worm gear.

9. The elevator system according to claim 1, further comprising:

a first operating power input to move at least a first portion of the plurality of support elements, the first operating power input being on a floor landing side of the supporting frame to enable the supply of power from the floor landing; and a second operating power input to move at least a second portion of the plurality of support elements, the second operating power input being at a horizontal distance from the support elements among the second portion of the plurality of support elements to enable use of the second power input from the movable supporting platform.

10. The elevator system according to claim 9, wherein the first portion of the plurality of support elements are positioned at beam ends of beams pointing in first and second of the four lateral directions, and the second portion of the plurality of support elements are positioned at beam ends of beams pointing in third and fourth of the four lateral directions, wherein the first and second lateral directions are opposite to one another, and the third and fourth lateral directions are opposite to one another.

11. The elevator system according to claim 9, wherein the first operating power input is electrically-driven.

12. The elevator system according to claim 1, wherein each of the plurality of support elements is configured to move telescopically relative to a respective one of the plurality of beams between the extended and retracted position.

13. The elevator system according to claim 1, wherein the movable supporting platform is configured to support the elevator car below the movable supporting platform.

14. The elevator system according to claim 1, wherein the beam ends pointing towards a first and a second of the four lateral directions are opposite to each other and arranged at a first horizontal distance from each other, and wherein the beam ends pointing towards a third and a fourth of the four lateral directions are opposite to each other and at a second horizontal distance from each other, the second horizontal distance being greater than the first horizontal distance.

15. The elevator system according to claim 1, wherein the plurality of beams is arranged such that two parallel beam ends of the supporting frame point towards each of two lateral directions of the movable supporting platform, the two lateral directions being opposite to each other, and wherein the two parallel beam ends are spaced apart from one another by a horizontal distance such that a car guide rail line passes through the space between the two parallel beam ends.

16. The elevator system according to claim 1, wherein the plurality of beams is arranged such that two parallel beam ends of the supporting frame point towards each of two opposite lateral directions of the movable supporting platform, and wherein when in the extended position each support element extends inside a pocket in a wall of the elevator hoistway, and the support element positioned at the beam end pointing towards a first or second direction rests on a top surface of an aperture of a floor landing.

17. The elevator system according to claim 1, wherein the supporting frame comprises:

a joint configured to rigidly fix at least a portion of the beam ends pointing towards different ones of the four lateral directions into a fixed position.

18. The elevator system of claim 1, wherein the four lateral directions are different and at least substantially orthogonal to one another.

19. A method for installing an elevator system, the method comprising:

changing a range of movement of an elevator car in an elevator hoistway by raising a movable supporting platform above the elevator car in the elevator hoistway, wherein the elevator system includes, a movable supporting platform to support elevator components in the elevator hoistway, the movable supporting platform including, a supporting frame having a plurality of support elements movable between an extended position and a retracted position, wherein, in the extended position, the plurality of support elements are configured to vertically support the movable supporting platform in the elevator hoistway when lowered to rest on wall structures of the elevator hoistway, and wherein, in the retracted position, the plurality of support elements are configured to allow movement of the movable supporting platform in the vertical direction in the elevator hoistway without obstruction, wherein the supporting frame includes, a plurality of beams that are rigidly fixed to each other, the plurality of beams being arranged such that two beam ends of the supporting frame point towards each of four lateral directions of the movable supporting platform, and wherein a support element from among the plurality of support elements is positioned at each of the at least one beam end.

20. The method according to claim 19, wherein the changing the range of movement of the elevator car comprises:

moving support elements of beams pointing towards first and second of the four lateral directions into the extended position;

moving support elements of beams pointing towards third and fourth of the four lateral directions into the extended position; and lowering the supporting frame on the wall structures of the elevator hoistway; wherein the first and second lateral directions are opposite to one another, and the third and fourth lateral directions are opposite to one another.

21. The method according to claim 20, wherein the support elements of the beams pointing towards the first and second lateral directions are moved into the extended position by supplying power to a power input on a floor landing side of the supporting frame.

22. The method according to claim 21, wherein the power input is configured to transmit at least one of push and pull force to at least a portion of the plurality of support elements.

23. The method according to claim 20, wherein the support elements of the beams pointing towards the first and second lateral directions are moved into the extended position from a floor landing of the building, and the support elements of the beams pointing towards the third and fourth lateral directions are moved into the extended position from the movable supporting platform.

24. The method according to claim 20, wherein the support elements of the beams pointing towards the third and fourth lateral directions are moved into the extended position by supplying power to an operating power input at a center area of the movable supporting platform.

25. The method according to claim 19, wherein a beam structure of the supporting frame forms a structure supporting machinery of a final machine room of the elevator system.

26. The method according to claim 25, wherein the changing the range of movement of the elevator car comprises:

lifting the supporting frame to move the plurality of beam ends into space reserved for the final machine room, the space being an extension of the elevator hoistway;

moving the plurality of support elements from the retracted position to the extended position; and lowering the supporting frame onto load-bearing structures of a building.

27. The method according to claim 19, further comprising:

fitting a fixed section of the plurality of beam ends to extend a first distance from the movable supporting platform by selecting a beam end of a first length, and rigidly fixing the selected beam end into position with an openable joint.

* * * * *